US011795752B2

(12) United States Patent
Libakken

(10) Patent No.: US 11,795,752 B2
(45) Date of Patent: Oct. 24, 2023

(54) DRIVE UNIT FOR MOVING A DOOR

(71) Applicant: WHEEL.ME AS, Oslo (NO)

(72) Inventor: Rolf Libakken, Båtsfjord (NO)

(73) Assignee: WHEEL.ME AS, Oslo (NO)

( * ) Notice: Subject to any disclaimer, the term of this patent is extended or adjusted under 35 U.S.C. 154(b) by 85 days.

(21) Appl. No.: 17/600,800

(22) PCT Filed: Mar. 19, 2020

(86) PCT No.: PCT/EP2020/057636
§ 371 (c)(1),
(2) Date: Oct. 1, 2021

(87) PCT Pub. No.: WO2020/200816
PCT Pub. Date: Oct. 8, 2020

(65) Prior Publication Data

US 2022/0162898 A1 May 26, 2022

(30) Foreign Application Priority Data

Apr. 2, 2019 (NO) ..... 20190448

(51) Int. Cl.
*E05B 47/00* (2006.01)
*E05F 15/632* (2015.01)
*E06B 3/46* (2006.01)

(52) U.S. Cl.
CPC ..... *E05F 15/632* (2015.01); *E06B 3/4636* (2013.01); *E05Y 2201/214* (2013.01);
(Continued)

(58) Field of Classification Search
CPC ..... E05F 15/632; E05F 15/619; E05F 15/641; E05F 15/635; E05F 15/63; E05F 15/06;
(Continued)

(56) References Cited

U.S. PATENT DOCUMENTS 4,520,592 A * 6/1985 Holloway ..... E05F 15/624 49/358
4,754,572 A * 7/1988 Bilt ..... E05F 15/632 49/358

(Continued)

FOREIGN PATENT DOCUMENTS

AT 506920 A1 * 12/2009 ..... E05F 15/635
CN 101351661 1/2009

(Continued)

OTHER PUBLICATIONS

International Search Report dated Jul. 2, 2020 in International (PCT) Application No. PCT/EP2020/057636.

(Continued)

*Primary Examiner* — Jerry E Redman
(74) *Attorney, Agent, or Firm* — Wenderoth, Lind & Ponack, L.L.P.

(57) ABSTRACT

The invention concerns a drive unit for moving a door relative to a door's opening. The drive unit comprises a drive motor and a wheel transmission assembly arranged for transfer of power to a drive wheel configured for engagement with a running surface for moving the door. The wheel transmission comprises a transfer wheel driven by the drive motor. A movable wheel carrier comprises a first running wheel and a second running wheel arranged in in engagement with the transfer wheel. The movable wheel carrier is arranged for displacement between a free wheel position where the first and second running wheel are arranged disengaged from the drive wheel for no power transfer to occur from the drive motor to the drive wheel, at least one running position where either of the first and second running wheel is positioned in engagement with the drive wheel for the transfer of power from the drive motor to the drive wheel.

10 Claims, 11 Drawing Sheets

(52) U.S. Cl.
CPC ... *E05Y 2201/234* (2013.01); *E05Y 2201/434* (2013.01); *E05Y 2201/674* (2013.01); *E05Y 2201/684* (2013.01); *E05Y 2201/71* (2013.01); *E05Y 2800/11* (2013.01); *E05Y 2900/132* (2013.01)

(58) Field of Classification Search
CPC ..... E05F 15/063; E06B 3/4636; E06B 3/46; E06B 3/487; E05Y 2201/214; E05Y 2201/234; E05Y 2201/434; E05Y 2201/674; E05Y 2201/684; E05Y 2201/71; E05Y 2201/216; E05Y 2800/11; E05Y 2900/132
USPC ..... 49/139, 140, 358
See application file for complete search history.

(56) References Cited

U.S. PATENT DOCUMENTS 5,440,837 A * 8/1995 Piltingsrud ..... E05D 15/22 74/625
6,575,864 B1 * 6/2003 Dean ..... E05F 15/603 475/5
6,711,855 B1 * 3/2004 Daniels ..... E05F 15/63 49/342
7,339,338 B2 * 3/2008 Theile ..... E05F 15/603 49/139
7,481,133 B2 * 1/2009 Walravens ..... E05F 15/603 49/140
7,856,759 B2 * 12/2010 Elliott ..... E05D 15/58 49/358
9,500,019 B2 * 11/2016 Haab ..... E05D 15/26
2005/0067990 A1 * 3/2005 Matsui ..... E05F 15/70 318/478
2005/0082998 A1 * 4/2005 Gregori ..... G05B 13/0265 318/466
2010/0154174 A1 * 6/2010 Haab ..... E05D 15/0604 49/358
2010/0319263 A1 * 12/2010 Taheri ..... E06B 9/70 310/80
2011/0072727 A1 * 3/2011 Kumazawa ..... G03G 15/605 16/72
2012/0272576 A1 11/2012 Van Tassell, III et al.
2018/0363356 A1 * 12/2018 Hohwart ..... E05F 15/641
2019/0078377 A1 3/2019 Jao et al.

FOREIGN PATENT DOCUMENTS

CN 103492205 A * 1/2014 ..... E05F 15/40
CN 107923206 4/2018
CN 108713125 10/2018
DE 1 036 105 8/1958
DE 26 43 905 2/1978
EP 1505239 A1 * 2/2005 ..... E05F 15/614
EP 2 169 170 3/2010
EP 2 692 975 2/2014
GB 2305228 A * 4/1997 ..... E05B 81/20
KR 10-2013-0035666 4/2013
WO 2008/061497 5/2008
WO 2015/140069 9/2015
WO 2017/036795 3/2017

OTHER PUBLICATIONS

Search Report dated Nov. 1, 2019 in Norwegian Application No. 20190448.

* cited by examiner

DRIVE UNIT FOR MOVING A DOOR

TECHNICAL FIELD

The present invention relates to the field of motorizing doors for facilitating the movement of the doors from open to closed position.

The doors may be interior doors or exterior doors for various use, but especially sliding doors for interior use, both in private homes and institutional buildings, are of particular interest.

BACKGROUND

Various known doors, both sliding and swinging doors, are motorized and automatically controlled to simplify the opening and closing of the door. These doors include sliding doors prepared for opening in response to detection of movement and doors equipped with handles or control buttons to activate the opening of the doors.

The following prior art documents describe motor operated sliding doors and the drive units for carrying out the operation of these doors; DE1036105, DE 2643905, WO 2015/140069, EP2169170, WO 2008/061497. The doors described in these documents are arranged with drive inserts for moving the doors into chosen position.

EP 2692975 discloses a drive unit which may be included into a door leaf during the manufacturing or may later be integrated in the door leaf in a retro fit installation. The drive unit may be used both for moving a sliding door and a swinging door. This drive unit has a drive motor which transmits power to a drive wheel via a gear transmission for moving the drive wheel in engagement with a rail mounted above the door or along a floor surface. Starting the drive motor actuates the drive unit into an extended position, where the drive wheel is in engagement with the rail. An overrunning clutch is arranged between the drive wheel and drive motor. The clutch is arranged to be engaged when starting the drive motor and disengaged in absence of power. When the door is to be moved manually the drive wheel is retracted and disengaged from the rail.

US20120272576 discloses an automatic sliding door which is arranged for activation by remote devices, including remote controllers, computers and cell phones or by a voice-activated signal.

The object of the present invention is to provide a drive unit for installment into door, suggesting an alternative to prior art solutions by providing a simple and reliable free-wheel mechanism that is easy to control and that also enable the manual movement of the door.

These and other characteristics of the invention will be clear from the following description of an exemplary embodiment, given as a non-restrictive example, with reference to the attached drawings.

SUMMARY OF THE INVENTION

The present invention relates to a drive unit for moving a door relative to a door's opening. The drive unit comprises a drive motor and a wheel transmission assembly arranged for transfer of power to a drive wheel for moving the door. The drive wheel may typically be configured for engagement with a running surface for instance a door rail above the door opening in order to move the door, further the drive wheel may comprise at least one tyre to ensure reliable engagement with the running surface.

The wheel transmission assembly comprises a transfer wheel driven by the drive motor. The movable wheel carrier comprises a first running wheel and a second running arranged in engagement with the transfer wheel. The movable wheel carrier is arranged for displacement between

- a free wheel position where the first and second running wheel are arranged disengaged from the drive wheel for no power transfer to occur from the drive motor to the drive wheel
- at least one running position, for instance a first and a second position running, where either of the first and second running wheel is positioned in engagement with the drive wheel for the transfer of power from the drive motor to the drive wheel.

When the movable wheel carrier is to be displaced between various running positions, the movable wheel carrier in the first running position may ensure that the sliding door is thereby to be moved in a selected direction for instance in the opening direction of the sliding door. Further, the movable wheel carrier in the second running position may ensure that the sliding door is to be moved in another selected direction for instance in the closing direction of the sliding door By this arrangement, the drive unit provides a motorized movement of the door when the movable wheel carrier is arranged in the running position(s) of the movable wheel carrier, but also enables manual movement of the door when the movable wheel carrier is in the free wheel position.

The drive unit may typically be applicable on a sliding door intended for in-door or out-door use, but also other kind of doors such as a swinging door may be a feasible use for the drive unit. These doors may be doors for closing off an interior room or zone, but also doors for cabinets, wardrobes or other furniture may be a feasible choice.

For displacement of the movable wheel carrier between the free wheel position and the running position(s) to select either the motorized movement of the door, or the possibility of moving the door by manual labour, the movable wheel carrier may be provided as follows;

One of the running wheels, for instance the first running wheel, may be arranged for restricted rotation relative to the movable wheel carrier. In one aspect, the movable wheel carrier may comprise a rotation restriction arrangement for restriction of the rotation of first running wheel to allow the first running wheel to follow the rotation of the transfer wheel for displacement of the movable wheel carrier from the free wheel position to the running position. The first running wheel may follow the rotation of the transfer wheel for a preset distance estimated to place the movable wheel carrier into the chosen running position.

To enable the displacement of the movable wheel carrier between the free wheel position and the running position(s), a first running wheel axle of the first running wheel may be arranged in a fixed manner to the movable wheel carrier. The movable wheel carrier may comprise a set of two support structures arranged with through holes for accommodation of end portions of the running wheel axles. The fixation of the first running wheel axle relative to the movable wheel carrier may be arranged by forming the end portion of the first running wheel axle which is to be accommodated in the through holes of the support structures, with a D-shaped cross section to prevent rotation of the first running wheel axle. Further the first running wheel may comprise a friction member, for instance positioned in a recess of the first running wheel, for interaction with the first running wheel axle to restrict the rotation of the first running wheel relative to the first running wheel axle. The friction member may comprise a spring or other devices providing friction, when engaging in contact with the first running wheel axle.

Alternatively, the restricted rotation arrangement of one of the running wheels may be carried out by clamping the wheel between the two support structures to obtain a friction effect due to engaging contact surfaces of the running wheel and at least one of the support structures.

The other of the first and second running wheel, namely the second running wheel, may typically be arranged essentially freely rotatable on its running wheel axle.

The drive unit may be arranged so that the drive wheel is movably arranged between an extended and a retracted position such that

- when the movable wheel carrier is arranged in the free wheel position, the drive wheel is arranged in the retracted position,
- when the movable wheel carrier is arranged in the running position(s), the drive wheel is arranged in the extended position.

When the drive wheel is placed in the extended position, and the movable wheel carrier is in the running position(s), the drive unit is prepared for the motorized movement of the door with drive wheel prepared for engagement with a running surface, for instance a door rail above the door. Further the ability to retract the drive wheel when the movable wheel carrier is arranged in the free wheel position facilitates the possibility for easy manual maneuvering of the door as the drive wheel then is disengaged from contact with the running surface.

The movable wheel carrier may be arranged for displacement into a first and a second running position. When in the first running position of the movable wheel carrier, the second running wheel may be placed in a transmission position engaging both the drive wheel and the transfer wheel for the transfer of power from the drive motor to the drive wheel. The displacement of the movable wheel carrier into the first running position and the following entrance of the second running wheel into the transmission position cause the shifting of drive wheel into the extended position.

Likewise when in the second running position of the movable wheel carrier, the first running wheel may be placed in the transmission position engaging both the drive wheel and the transfer wheel for the transfer of power from the drive motor to the drive wheel. The displacement of the movable wheel carrier into the second running position and the following entrance of the first running wheel into the transmission position cause the shifting of drive wheel into the extended position.

And vice versa, the displacement of the movable wheel carrier from the running positions and into the free wheel position moves the first running wheel/second running wheel away from the transmission position and thus retracts the drive wheel.

The operation modes of the drive motor control the position of the movable wheel carrier, when the drive motor is

- in driving mode forward direction or driving mode reverse direction, the movable wheel carrier may be arranged for displacement from the free wheel position and into the running position(s)
- in neutral mode, the movable wheel carrier may arranged for displacement from the running position(s) to the free wheel position.

For controlling the drive unit, a control unit may be included into the drive unit for controlling the operation modes of the drive motor. The control unit may be arranged for receiving control signals for operation of the drive motor from a remote control, computers, cell phones or by voice-activation. The drive unit may also be activated by a detector sensing an approaching person. Alternatively, the control signals may be received from a control button on the drive unit, the door or in the vicinity or distant to the door.

The drive unit may be arranged as an insert to be included in the door by a retrofitted installment procedure or during the manufacture of the door. The drive unit may be installed into existing doors, such as when a need has arisen for motorizing the movement of the door, for instance at hospitals or internal or external environments where the opening and closing of doors are a burden to the operator of the door. The drive unit may typically be installed in a top portion of the door suitable for the drive wheel to interact with the door rail mounted above the door. Alternatively, the drive unit may be arranged in a lower portion of the door where the drive wheel may be arranged for interaction with a door rail or with another suitable surface, for instance the floor.

The drive unit may comprise a drive unit housing arranged with a guide recess for guidance of the displacement of the movable wheel carrier. As such the boundaries of the guide recess may function as an end stop for ensuring the positioning of the movable wheel carrier in the running position. The drive unit housing may also be arranged with a vertical slot for guidance of the movement of the drive wheel.

The drive unit may comprise a spring unit with a preset spring force for providing resiliency to the drive wheel in the extracting/retracting direction of the drive wheel. The drive unit may also comprise adjustment means for regulation of the position such as the height/vertical position of the drive unit relative the door.

A method for operation of the drive unit to move a door relative to a door's opening may include starting the drive motor and selecting a driving mode forward direction or a or driving mode reverse direction for the drive motor. The selection of driving mode forward direction displaces the movable wheel carrier from free wheel position into first running position thereby transferring the power from the drive motor via the wheel transmission assembly to drive wheel to move the door in a first direction. The selection of driving mode reverse direction displaces the movable wheel carrier from free wheel position into second running position thereby transferring the power from the drive wheel via the wheel transmission assembly to the drive wheel to move the door in a second direction opposite to the first direction.

BRIEF DESCRIPTION OF THE DRAWINGS

FIG. 1 shows a sliding door 1 with a drive unit 2 installed in the sliding door 1. As shown in FIG. 1, the sliding door 1 is arranged to be moved along a door rail 3 for covering and uncovering of a door opening 4.

Figure 1:
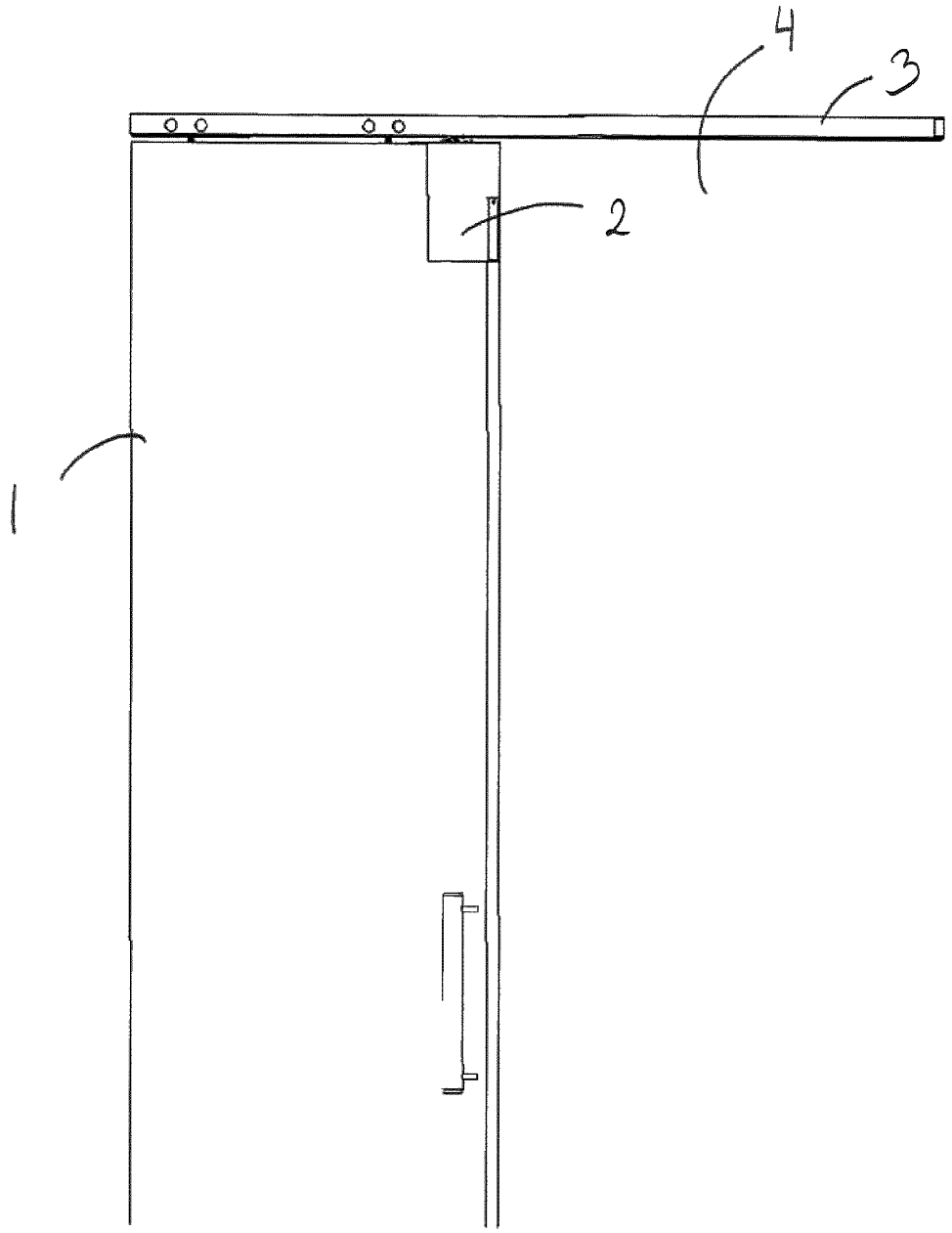
FIG. 1 is a schematic front view of a sliding door with the drive unit insert.

The drive unit 2 may be retrofitted into the sliding door 1 or may be included in the sliding door 1 during the manufacture of the sliding door 1. The drive unit 2 is shown included in the sliding door in FIG. 1, but the drive unit 2 may also be included in other kind of doors such as a swinging door (not shown).

FIG. 2 shows the arrangement of the drive unit 2 in more detail. A drive motor 5 provides power for the propulsion of a drive wheel 6. The drive wheel 6 is arranged with a drive wheel axis having two end portions 22, 23, each bearing a drive wheel tyre 20, 21, wherein each tyre is arranged for engagement with the door rail 3 for moving the sliding door 1. The drive wheel tyre 20, 21 may for instance be manufactured in rubber.

The drive motor 5 is arranged with a drive motor wheel 7 which is arranged in engagement with a transfer wheel 8. The drive motor wheel 7 is shown as a bevel wheel (shaped as right circular cone with a tip cut off). The drive motor wheel 7 is shown in a meshing engagement with a first transfer wheel section 8*a* of the transfer wheel 8. The first transfer wheel section 8*a* is illustrated with a bevel wheel configuration. The transfer wheel 8 also has a second transfer wheel section 8*b*, which is shown with the configuration of a spur wheel (a disk with teeth projecting radially). The second transfer wheel section 8*b* is arranged for engagement with a first running wheel 9 and a second running wheel 10 (Both running wheels are shown with spur wheel configuration). The first and second running wheel 9, 10 are connected to a movable wheel carrier 11 which is arranged for sliding movement in opposite directions as illustrated by arrow A following the guide recess 51 as shown in drive unit housing 12. The movable wheel carrier 11 is placed in a position in between the transfer wheel 8 and the drive wheel 6. In the situation as shown in FIG. 2, the movable wheel carrier 11 is arranged in a free wheel position where the first and second running wheel 9, 10 are engaged with the second transfer wheel section 8*b*, while disengaged from the drive wheel 6. As such no power is transferred from the drive unit 5 to the drive wheel 6, when the wheel carrier 11 is arranged in the free wheel position.

Figure 2A:
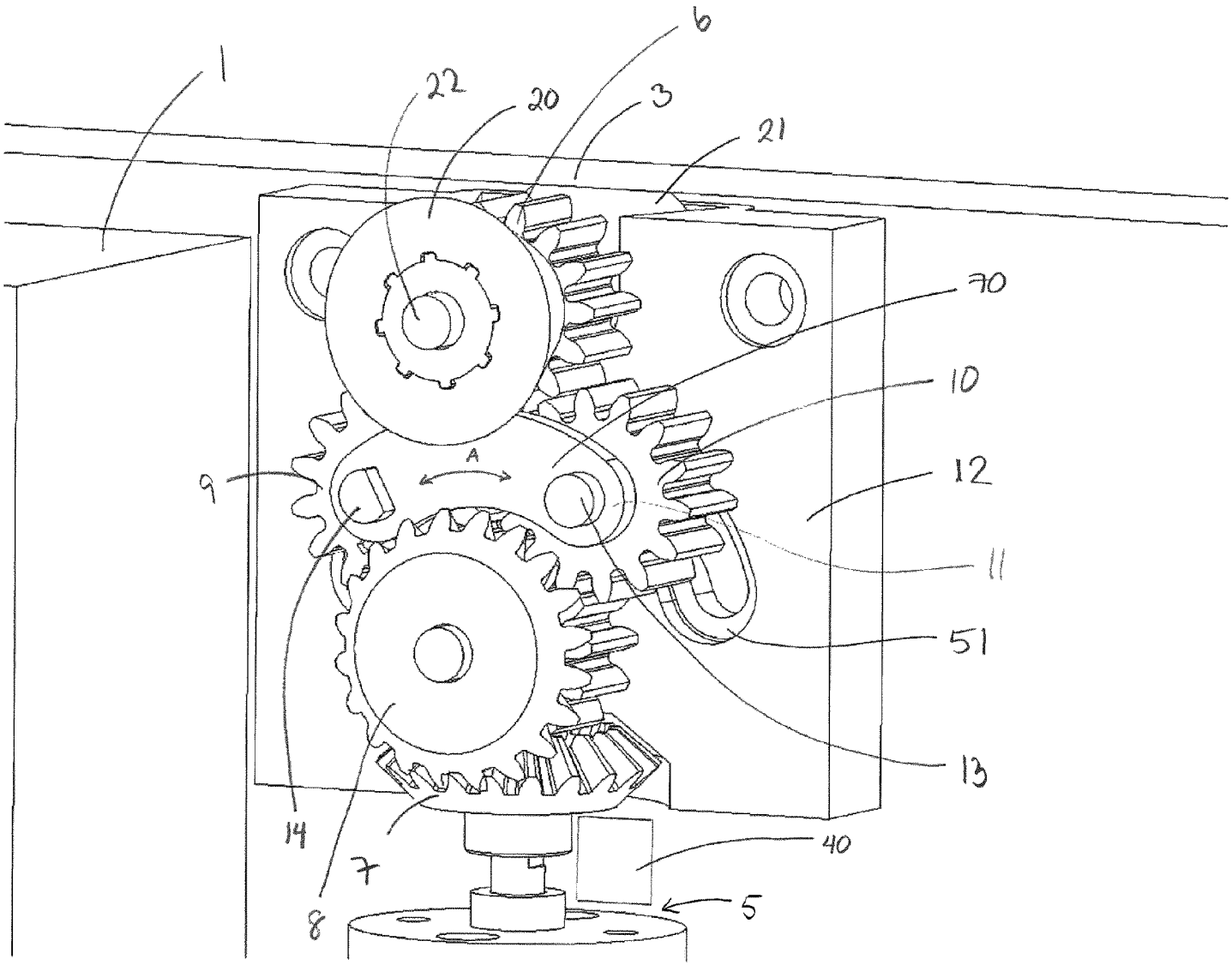
FIG. 2*a* is a schematic sectional perspective showing a drive assembly of the drive unit in a free mode.
Figure 2B:
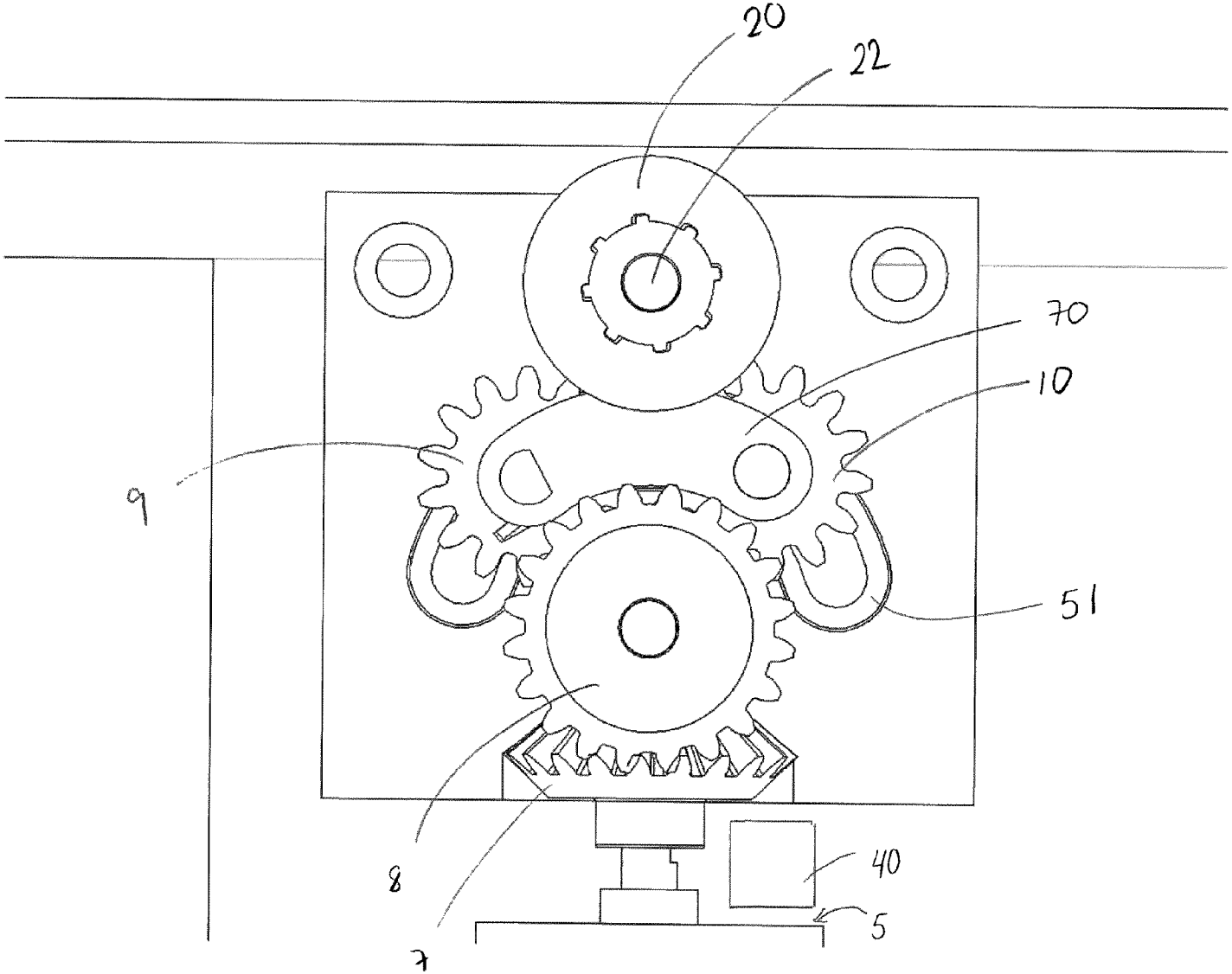
FIG. 2*b* is a schematic sectional front view showing a drive assembly of the drive unit in a free mode.
Figure 3:
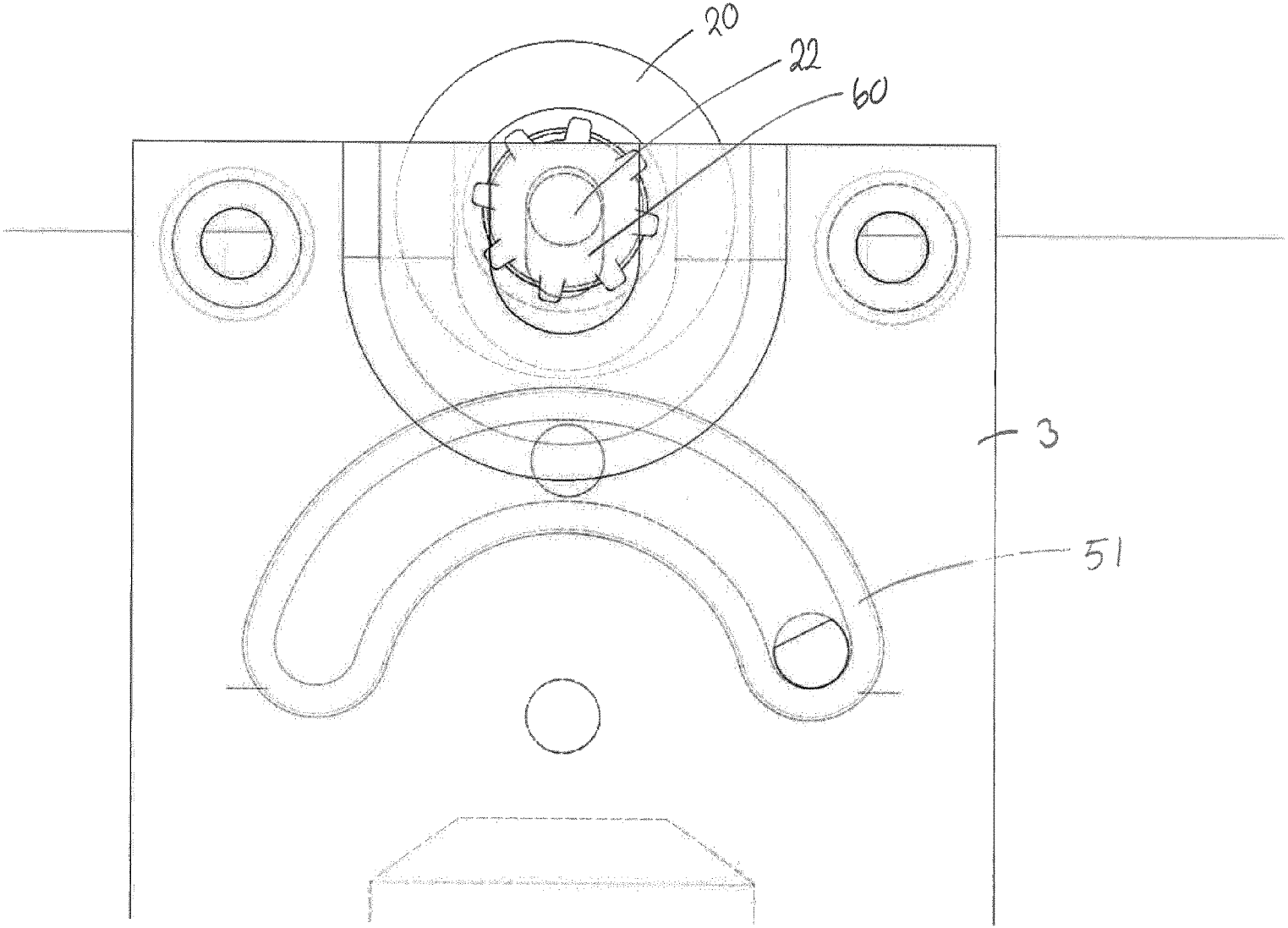
FIG. 3 shows a detail of a drive wheel of the drive assembly as shown in FIG. 2.

The drive unit housing 12 is arranged with a vertical slot 60 see FIG. 3, for supporting the retraction and extension of the drive wheel 6 relative to the drive unit housing 12. When the movable wheel carrier 11 is in the free wheel position as shown in FIGS. 2*a* and 2*b*, the drive wheel 6 is placed in retracted position away from engagement with the door rail 3. The sliding door 1 may now be moved freely by manual effort without the drive wheel 6 interfering with the door rail 3. When the movable wheel carrier 11 is in the running position as shown in FIG. 4, the drive wheel 6 is placed in extended position and in engagement with the door rail 3. The sliding door 1 may now be moved by power transferred from the drive motor 5 to the drive wheel 6 for movement of the sliding door 1 along the door rail 3

Figure 6:
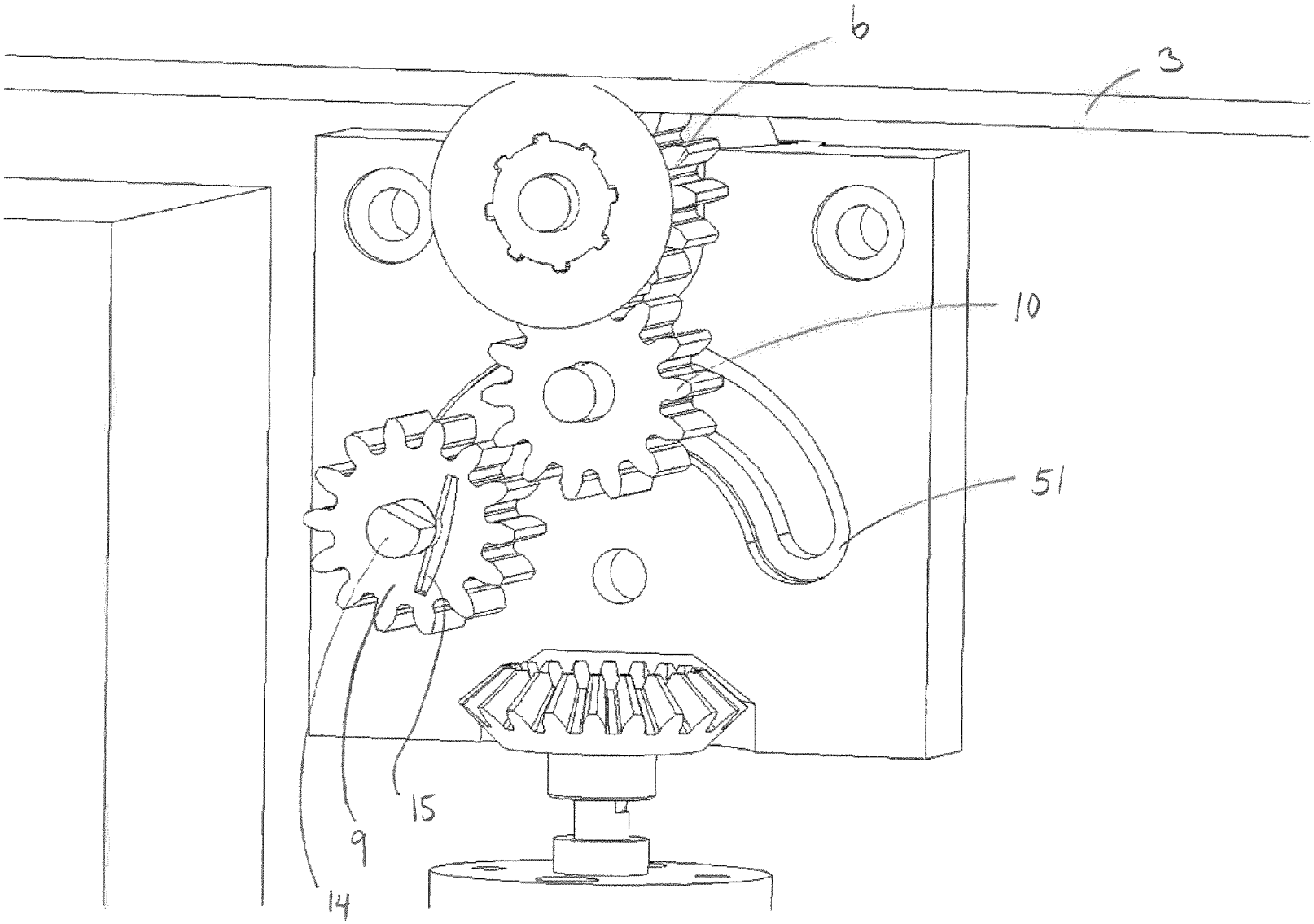
FIG. 6 shows a schematic sectional view of FIG. 5.

The second running wheel 10 is arranged for rotation relative to the movable wheel carrier 11 by the accommodation of second running wheel axle 13 in through holes of support structures 70, 71 of the movable wheel carrier 1. The first running wheel 9 is arranged for restricted rotation relative to the movable wheel carrier 11. As seen in FIG. 6 the first running wheel axle 14 has D-shaped cross section, which will prevent rotation of the first running wheel axle 14 relative to the support structures 70, 71 of the movable wheel carrier 11. Further a friction member 15 such as spring (or any other friction member) is accommodated in a recess (not shown) of the first running wheel 9. The friction member 15 is positioned for establishment of frictional contact with the first running wheel axle 14 to restrict the rotation of the first running wheel 9 relative to the first running wheel axle 14. By this arrangement, the movable wheel carrier 11 is able to move from the free wheel position as shown in FIGS. 2*a* and 2*b*, to either of the running positions as show in FIGS. 4*a* and 4*b*.

Alternatively, the restricted rotation of one of the running wheels may be carried out by clamping the first wheel 9 between the two support structures 70, 71 to obtain a friction effect due to engaging contact surfaces of the running wheel and one or both of the support structures 70, 71.

Figure 4A:
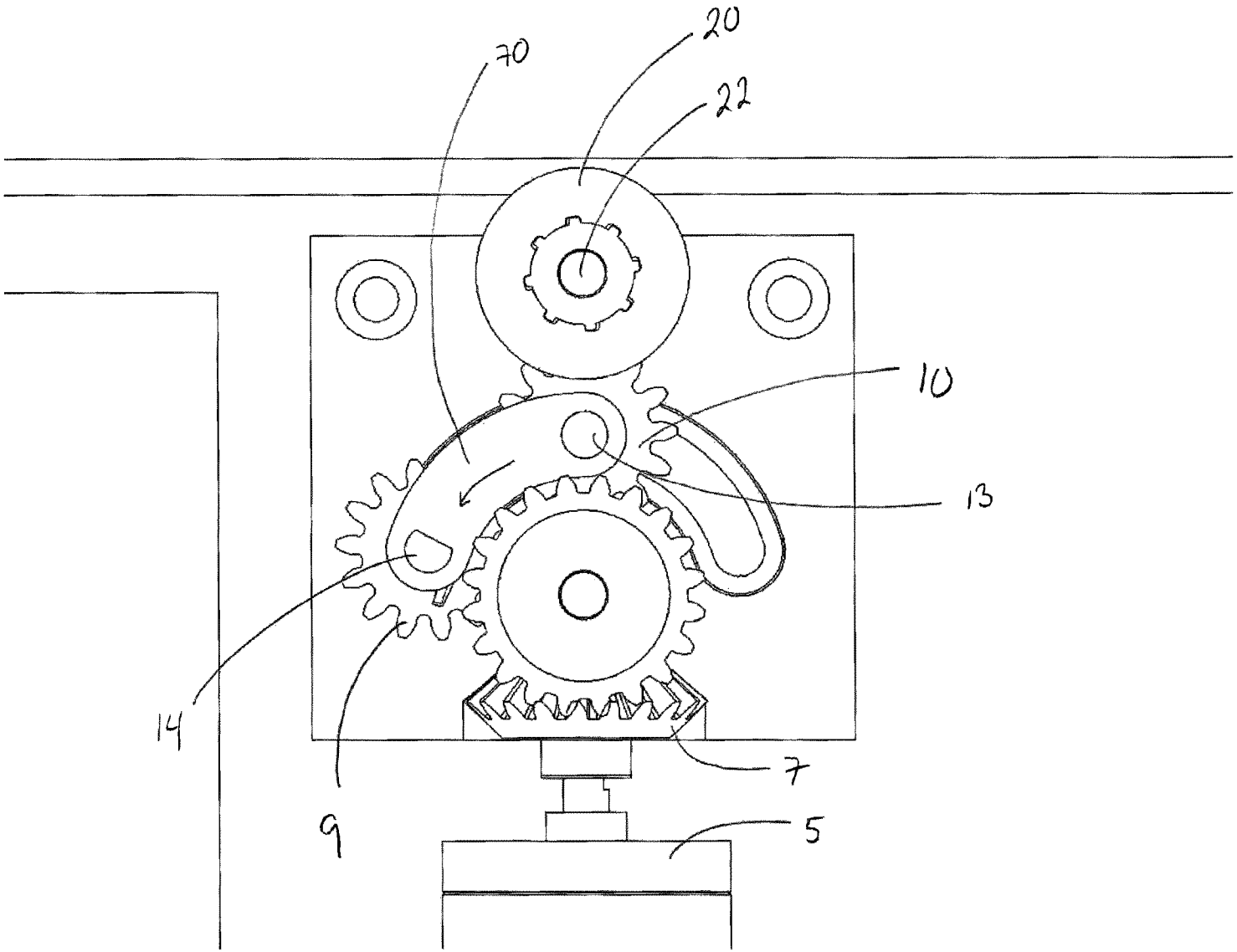
FIG. 4*a* is a schematic sectional front view of the drive assembly of FIG. 2 in one drive mode.
Figure 4B:
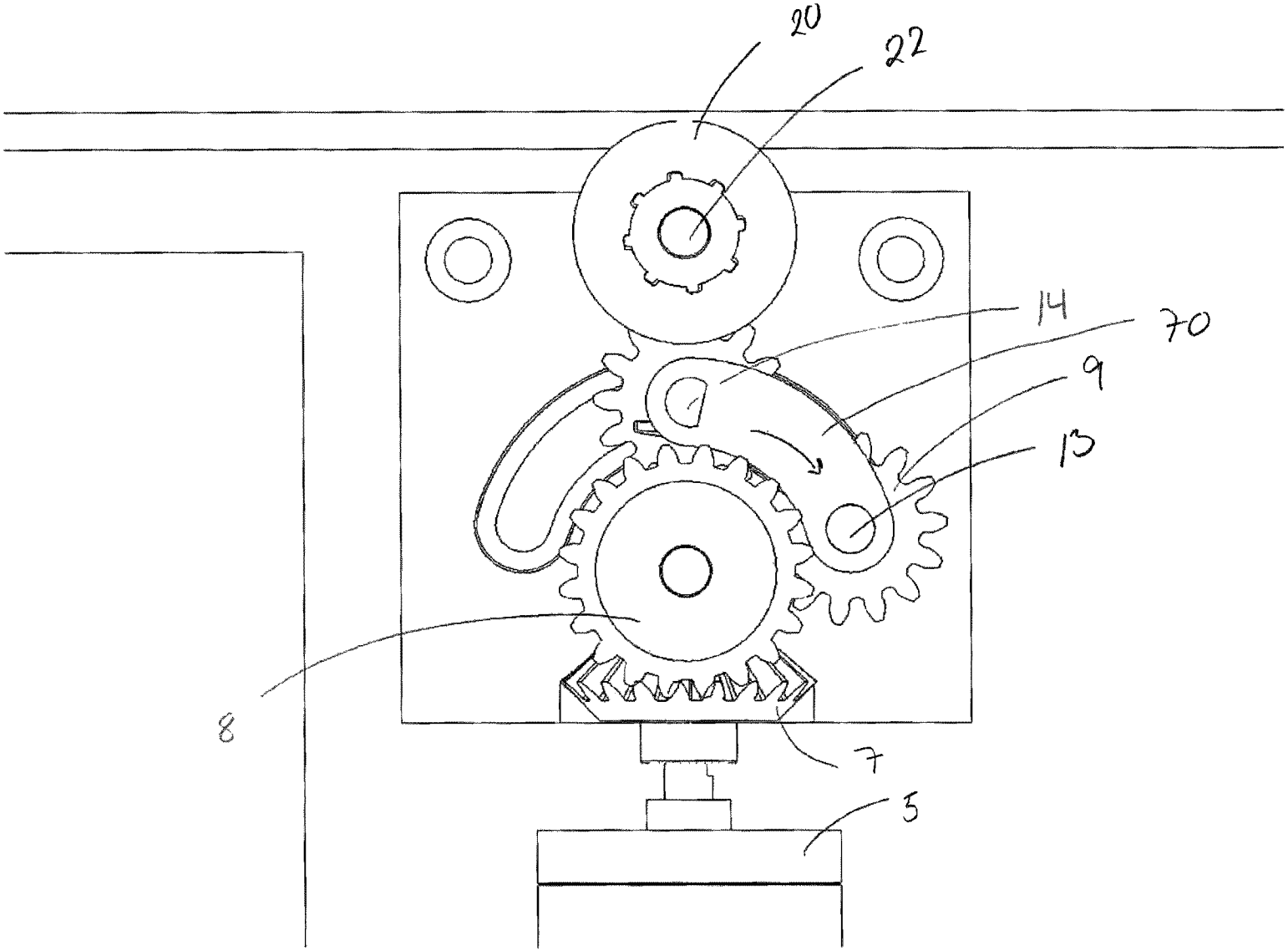
FIG. 4*b* is a schematic sectional front view of the drive assembly of FIG. 2 in a drive mode different from the one illustrated in FIG. 4*a*.
Figure 5A:
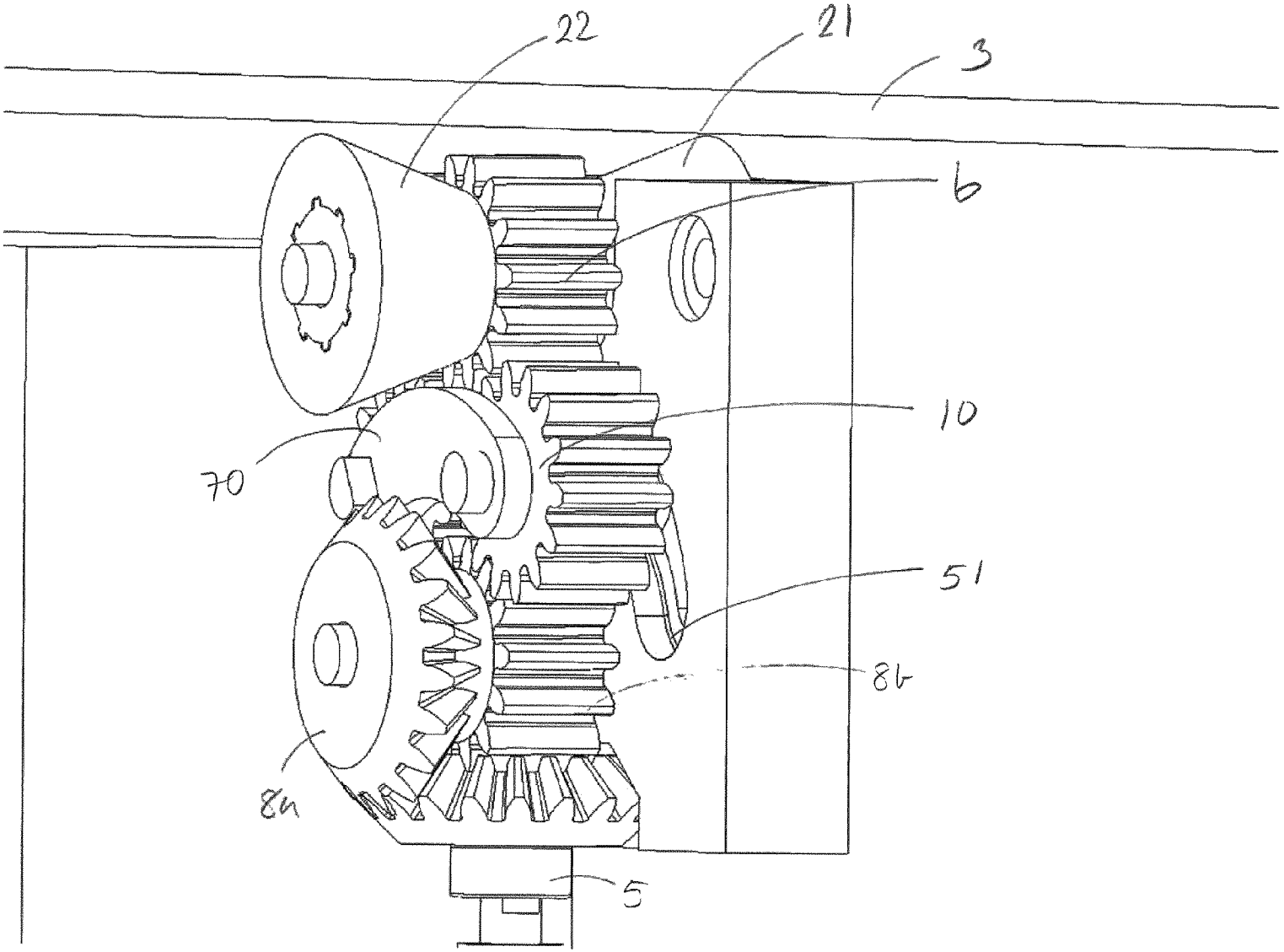
FIG. 5*a* is a schematic perspective side view of the drive assembly in neutral mode
Figure 5B:
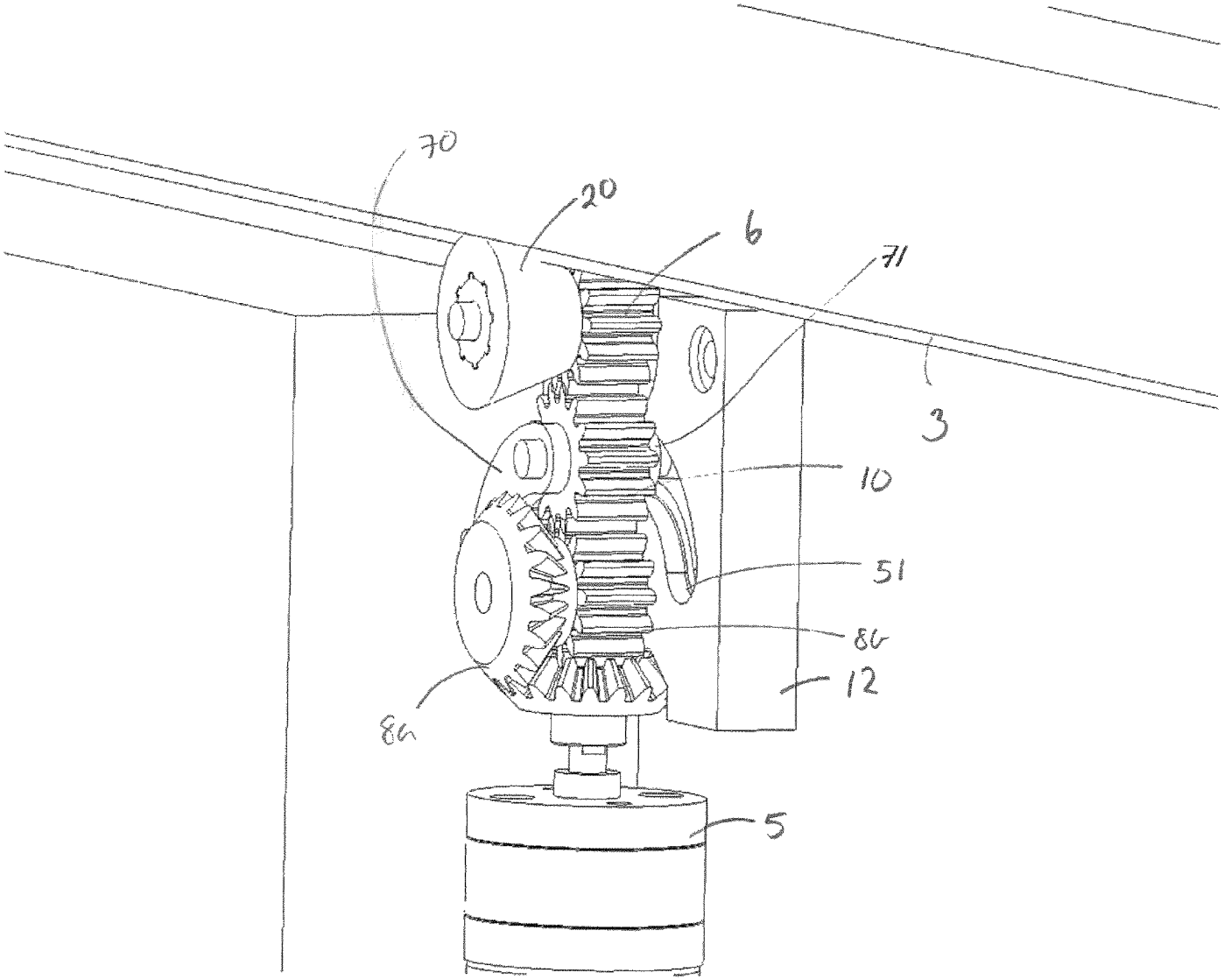
FIG. 5*b*, is a schematic perspective side view of the drive assembly as shown in FIG. 4*a*.

When starting from the free wheel position of FIGS. 2*a* and 2*b*, the running drive motor 5 rotates the drive motor wheel 7 and transfer wheel 8, and these movements are transferred to the first and second running wheel 9, 10. The second running wheel 10 then rotates freely in an intermeshing engagement with the transfer wheel 8, while the movement of the first running wheel 9 is restricted due to the friction arrangements as described above e.g the friction member 15 and the D-shaped first running wheel axle 14. This restricted rotation of the first running wheel 9 causes the first running wheel 9 to follow the rotation of the transfer wheel 8, and as shown in FIGS. 4*a* and 4*b*, the movable wheel carrier 11 is then displaced to the first and second running position. The direction of rotation of the drive motor wheel 7 actuates the displacement of the movable wheel carrier 11 into either the first or second running position. When the drive motor 5 is controlled to rotate the drive motor wheel 7 in a first direction, the movable wheel carrier 11 is actuated to be displaced from free wheel position to a first running position as illustrated in FIG. 4*a*. The displacement of the movable wheel carrier 11 shifts the second running wheel 10 into a transmission position engaging both the drive wheel 6 and the transfer wheel 8 for transmission of rotation from the drive motor 5 to the drive wheel 6. The displacement of the second running wheel 10 into the transmission position causes the shifting of drive wheel 6 into the extended position to engage the door rail 3. The sliding door is thereby prepared to be moved in a first direction for instance in the opening direction of the sliding door.

FIG. 4*b* shows the movable wheel carrier 11 in a second running position, as moved from the free wheel position illustrated in FIG. 2*a*, 2*b*. The drive motor 5 is then controlled to rotate the drive motor wheel 7 in a second direction, and the movable wheel carrier 11 is actuated to be displaced from free wheel position to the second running position as illustrated in FIG. 4*b*. In the second running position the first running wheel 9 is shifted into the transmission position engaging both the drive wheel 6 and the transfer wheel 8 for transmission of rotation from the drive motor 5 to the drive wheel 6. The displacement of the first running wheel 9 into the transmission position causes the shifting of drive wheel 6 into the extended position to engage the door rail 3. The sliding door 1 is thereby to be moved in a second direction opposite to that of FIG. 4*a*, for instance in the closing direction of the sliding door.

Figure 7:
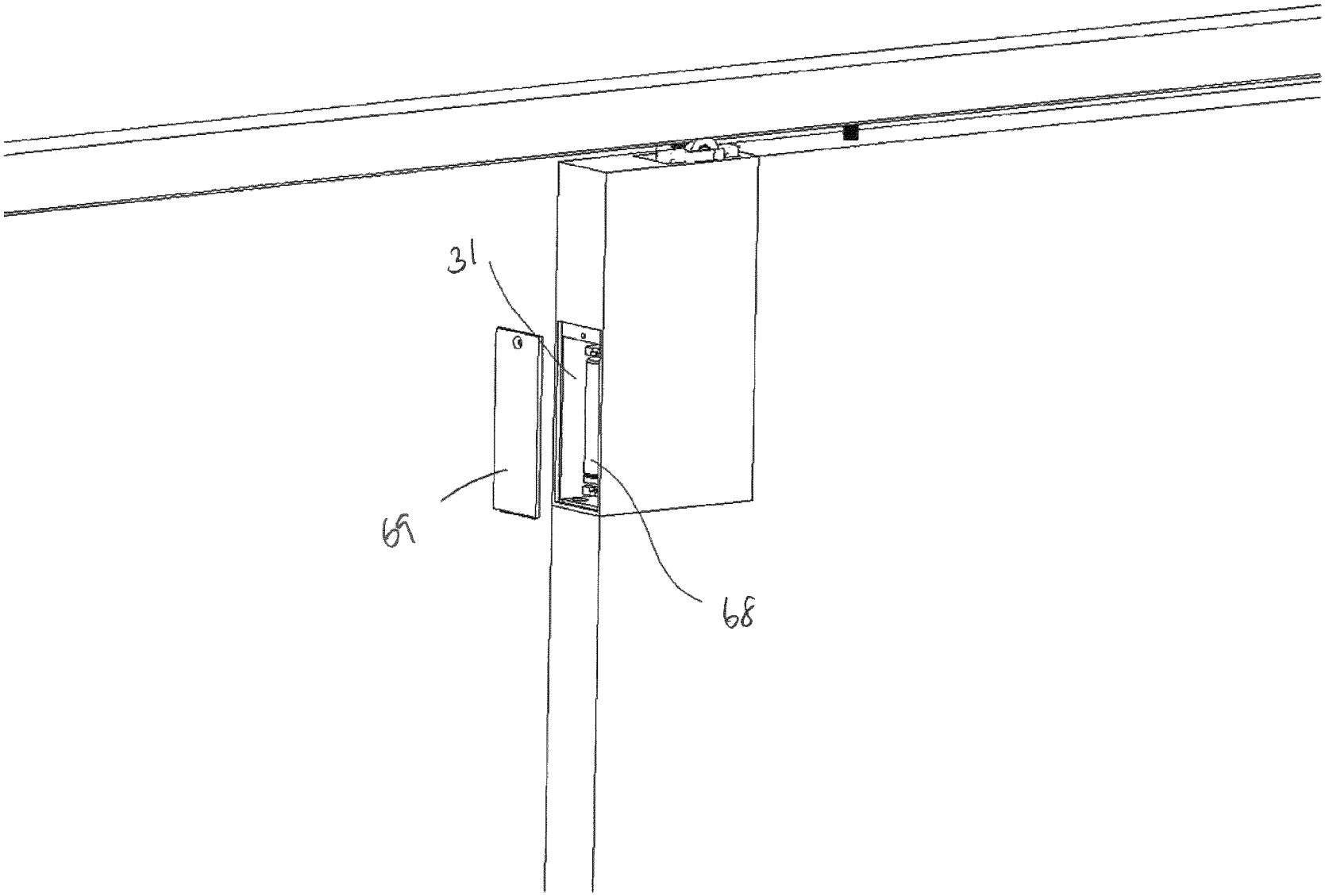
FIGS. 7 and 8 is a detailed illustration of the drive unit as included in the sliding door of FIG. 1.
Figure 8:
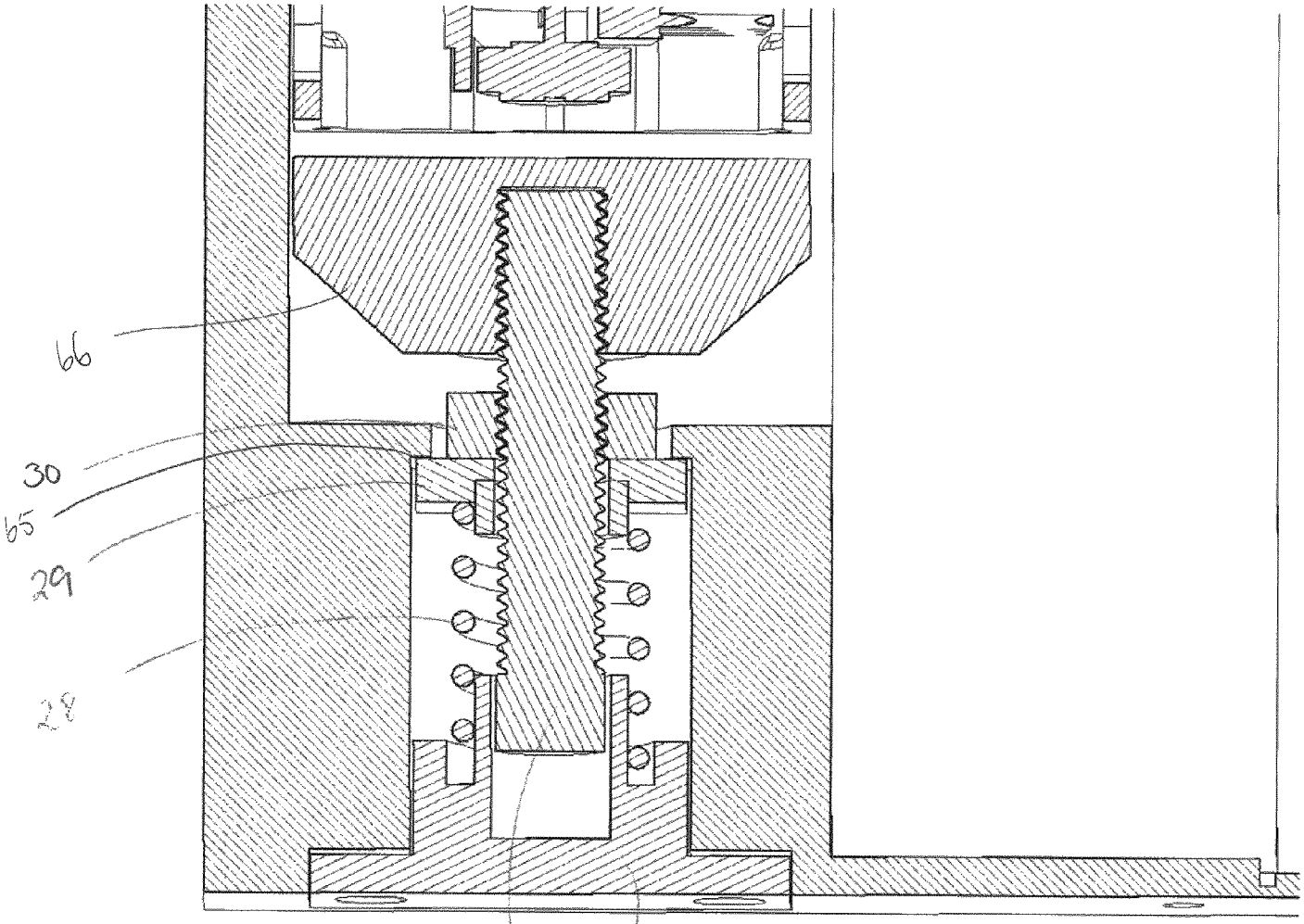

The drive unit 2 as shown installed in the sliding door 1 in FIG. 8 is arranged with a pretensioned spring unit 25 providing resiliency for the drive wheel 6 in the extracting/ retracting direction of the drive wheel. The pretensioned spring unit 25 comprises a threaded bolt 26 with one end accommodated in a base structure 27 connected to the sliding door 1. The other end of the threaded bolt 26 is connected to a lower end portion 66 of the drive unit 2. A spring element 28 extends from the base structure 27 and along an axial portion of the threaded bolt 26 to an end stop 29, which rests against a stop surface 65. A nut 30 is provided for regulation of the position of the threaded bolt to adjust the height position of the drive unit 2 relative the door. A storage space 31 for a battery package 68 which provides power to the drive motor, is shown in FIG. 7. The storage space is arranged with a removable lid 69 is. The battery package may be rechargeable and is mounted so that is easy to replace by a single hand grip operation.

A control unit 40 for controlling the drive motor 5 is shown in the figures. The control unit 40 may receive control signals for starting, stopping, regulation of rotational speed etc from a remote control, computers, cell phones or by voice-activation. Alternatively or in addition the drive motor 5 may be controlled by a control button arranged on or in the vicinity of the sliding door.

The invention claimed is:

1. A drive unit which moves a door relative to a door opening, wherein the drive unit comprises a drive motor and a wheel transmission assembly arranged to transfer power to a drive wheel configured to engagement with a surface for moving the door, the wheel transmission assembly comprises a transfer wheel driven by the drive motor and a movable wheel carrier which comprises a first rotatable wheel and a second rotatable wheel arranged in engagement with the transfer wheel, wherein the movable wheel carrier is arranged and displaced between, a free wheels position where the first and second rotatable wheel are disengaged from the drive wheel so that no power transfer to occurs from the drive motor to the drive wheel, and at least one engagement position where either of the first rotatable wheel and second rotatable wheel is positioned in engagement with the drive wheel to transfer power from the drive motor to the drive wheel.

2. A drive unit in accordance with claim 1, wherein the movable wheel carrier comprises a rotation restriction arrangement for restriction of rotation of the first rotatable wheel to allow the first rotatable wheel to follow a rotation of the transfer wheel for displacement of the movable wheel carrier from the free wheel position to at least one of the at least one engagement position.

3. A drive unit in accordance with claim 1, wherein the first rotatable wheel has an axle arranged in a fixed manner to the movable wheel carrier, and the first rotatable wheel comprises a friction member for interaction with the axle to restrict the rotation of the first rotatable wheel relative to the axle.

4. A drive unit in accordance with claim 1, wherein the drive wheel is movably arranged between an extended and a retracted position and when the movable wheel carrier is arranged in the free wheel position, the drive wheel is in the retracted position, and when the movable wheel carrier is arranged in at least one of the at least one running position, the drive wheel is in the extended position.

5. A drive unit in accordance with claim 1, wherein the movable wheel carrier is arranged for displacement into a first running position and a second running position; wherein in the first running position, the second rotatable wheel is placed in a transmission position engaging both the drive wheel and the transfer wheel, in the second running position, the first rotatable wheel is placed in the transmission position engaging both the drive wheel and the transfer wheel, and wherein an entrance of either of the first rotatable wheel and the second rotatable wheel into the transmission position causes a shifting of the drive wheel into the extended position.

6. A drive unit in accordance with claim 5, further comprising a control unit that controls operation modes of the drive motor, wherein and the control unit receives control signals for operation of the drive motor from a remote control, computers, cell phones or by voice-activation.

7. A drive unit in accordance with claim 1, wherein operation modes of the drive motor control a position of the movable wheel carrier, when the drive motor is in a driving mode forward direction or a driving mode reverse direction, the movable wheel carrier is moved from the free wheel position to at least one of the at least one engagement position, and in a neutral mode, the movable wheel carrier is moved from at least one of the at least one engagement position to the free wheel position.

8. A drive unit in accordance with claim 1, wherein the drive unit is arranged as an insert to be included in the door by a retrofitted installment procedure or during manufacture of the door.

9. A drive unit in accordance with claim 1, further comprising a drive unit housing arranged with a guide recess for guidance of the movable wheel carrier and vertical slot for guidance of the drive wheel.

10. A drive unit in accordance with claim 1, further comprising a spring unit having a preset spring force for providing resiliency to the drive wheel in an extracting/retracting direction of the drive wheel, and adjustment means for regulation of a position of the drive unit relative to the door.

* * * * *